US010532562B2

(12) United States Patent
Khalate et al.

(10) Patent No.: US 10,532,562 B2
(45) Date of Patent: Jan. 14, 2020

(54) DROPLET EJECTING DEVICE

(71) Applicant: OCE-TECHNOLOGIES B.V., Venlo (NL)

(72) Inventors: Amol A. Khalate, Venlo (NL); Johannes M. M Simons, Venlo (NL); Marko Mihailovic, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 114 days.

(21) Appl. No.: 15/903,967

(22) Filed: Feb. 23, 2018

(65) Prior Publication Data

US 2018/0178506 A1 Jun. 28, 2018

Related U.S. Application Data

(63) Continuation of application No. PCT/EP2016/069223, filed on Aug. 12, 2016.

(30) Foreign Application Priority Data

Aug. 25, 2015 (EP) ..... 15182253

(51) Int. Cl.
*B41J 2/045* (2006.01)
*B41J 2/14* (2006.01)

(52) U.S. Cl.
CPC ..... *B41J 2/0451* (2013.01); *B41J 2/0453* (2013.01); *B41J 2/04581* (2013.01); (Continued)

(58) Field of Classification Search
CPC .... B41J 2/0451; B41J 2/0453; B41J 2/14032; B41J 2/14233; B41J 2/04581; B41J 2002/14354
See application file for complete search history.

(56) References Cited

U.S. PATENT DOCUMENTS

2005/0212845 A1 9/2005 Shinkawa
2006/0082617 A1* 4/2006 Nagashima ..... B41J 2/0451 347/68

(Continued)

FOREIGN PATENT DOCUMENTS

EP 1378359 A1 1/2004
JP 2002-46264 A 2/2002

(Continued)

OTHER PUBLICATIONS

International Search Report, issued in PCT/EP2016/069223, PCT/ISA/210, dated Nov. 11, 2016.

(Continued)

*Primary Examiner* — Justin Seo
(74) *Attorney, Agent, or Firm* — Birch, Stewart, Kolasch & Birch, LLP

(57) ABSTRACT

A droplet ejection device has a nozzle head with a plurality of ejection units, each of which includes a nozzle, a duct connected to the nozzle, and an electromechanical transducer arranged to create a pressure wave in a liquid in the duct so as to expel a droplet of the liquid from the nozzle. The device further includes an electronic control circuit arranged to apply control signals to the transducers and to receive detection signals that are generated in the transducers in response to the transducer being exposed to pressure fluctuations. The nozzle head includes a reference duct which has an electromechanical transducer serving as a reference transducer. The control circuit is arranged to subtract a detection signal of the reference transducer from a detection signal of at least one of the ejection units.

11 Claims, 2 Drawing Sheets

(52) U.S. Cl.
CPC ..... *B41J 2/14032* (2013.01); *B41J 2/14233* (2013.01); *B41J 2002/14354* (2013.01)

(56) References Cited

U.S. PATENT DOCUMENTS

| | | | | |
|---|---|---|---|---|
| 2006/0268046 | A1 | 11/2006 | Ootsuka | |
| 2008/0136859 | A1 | 6/2008 | Kim et al. | |
| 2012/0293576 | A1* | 11/2012 | Kim | B41J 2/0451 347/10 |
| 2018/0079208 | A1* | 3/2018 | Newcombe | B41J 2/04541 |

FOREIGN PATENT DOCUMENTS

| | | | |
|---|---|---|---|
| WO | WO 01/36202 | A1 | 5/2001 |
| WO | WO 2010/023135 | A1 | 3/2010 |

OTHER PUBLICATIONS

Written Opinion of the International Searching Authority, issued in PCT/EP2016/069223, PCT/ISA/237, dated Nov. 11, 2016.

* cited by examiner

DROPLET EJECTING DEVICE

CROSS REFERENCE TO RELATED APPLICATIONS

This application is a Continuation of PCT International Application No. PCT/EP2016/069223 filed on Aug. 12, 2016, which claims priority under 35 U.S.C. § 119(a) to Patent Application No. 15182253.3 filed in Europe on Aug. 25, 2015, all of which are hereby expressly incorporated by reference into the present application.

BACKGROUND OF THE INVENTION

The invention relates to a droplet ejection device having a nozzle head with a plurality of ejection units each of which comprises a nozzle, a duct connected to the nozzle, and an electromechanical transducer arranged to create a pressure wave in a liquid in the duct so as to expel a droplet of the liquid from the nozzle, the device further comprising an electronic control circuit arranged to apply control signals to the transducers and to receive detection signals that are generated in the transducers in response to the transducer being exposed to pressure fluctuations in the liquid.

Such a droplet ejection device may for example be employed in an ink jet printer or a 3D printer. EP 1 378 359 A1 describes an ink jet printer having an ejection device of the type indicated above, wherein the transducers are formed by piezoelectric transducers. When a voltage is applied across electrodes of the transducer, the piezoelectric material is caused to deform, whereby the volume of the duct is changed and a pressure wave is induced in the liquid ink that is contained in the duct. Conversely, when the transducer is subject to pressure fluctuations in the liquid ink, which may be caused for example by an acoustic wave still present in the duct after the nozzle has been fired, these pressure fluctuations will induce voltage fluctuations which may be detected in the electronic control system. In the known printer, this effect is utilized for monitoring the functioning of the droplet ejection devices.

In general, a detection signal from a transducer as a result of pressure fluctuations is much smaller than a control signal, or an actuation pulse, that is applied to the transducer in order to expel a droplet. It is therefore common practice to connect the transducer either to a control circuit for applying an actuation pulse or to a detection circuit for detecting the pressure fluctuations. This restricts the time window for measuring these fluctuations, since it is necessary to switch from one circuit to another. Moreover, the pressure fluctuations during actuation cannot be measured, although the pressure fluctuations during actual actuation may contain very valuable information on the status of the ejection unit.

It is an object of the present invention to provide a droplet ejection device of the type indicated above, wherein fluctuations can be measured during the application of an actuation pulse.

SUMMARY OF THE INVENTION

In a first aspect, the object is achieved in a droplet ejection device according to claim 1. According to the present invention, the nozzle head as described above further comprises a reference unit with a reference duct, which is designed to contain no liquid in operation, herein also referred to as a dummy duct, which has an electromechanical transducer serving as a reference transducer, and the control circuit is arranged to subtract a detection signal of the reference transducer from a detection signal of the transducer of at least one of the ejection units.

The invention has the advantage that even during application of an actuation pulse, a measurement of the pressure fluctuations may take place, since the actuation pulses in the detection signal of the at least one of the ejection units and the reference unit cancel by the subtraction in the control circuit. Only the detection signal of the at least one of the ejection units comprises a contribution from the pressure fluctuations, since, in operation, the reference duct of the reference unit does not contain liquid. Therefore, the signal caused by the pressure fluctuations is not lost by the subtraction.

Based on the resulting signal, only containing signal contributions from the pressure fluctuations, an accurate analysis of the ejection unit status is enabled. Moreover, in view of the removal of the actuation signal by subtraction, it is enabled to analyze the pressure fluctuations in the liquid during the application of the actuation pulse.

The inventors have found that a fixed reference capacitor is insufficient for cancelling an actuation pulse, because the capacitance of an electromechanical transducer is not sufficiently stable. As a result, the actuation pulse may not be sufficiently suppressed by subtraction. Since the actuation pulse is so much larger than the detection signal, a small remaining part of the actuation pulse will easily transcend the detection signal. Further, the availability of a reference transducer with a reference duct without liquid makes the detection of the signals from the transducers of the ejection units more robust against vibrations that may be induced in the nozzle head from outside, against a temperature drift of the electronic properties of the transducers, and against ageing effects of the transducers. Such effects, which may compromise the detection of the signals that shall be processed for monitoring the functioning of the ejection units, will affect the transducers of the ejection units and the reference transducer essentially in the same manner, so that, by subtracting the signals of these transducers from one another, it is possible to suppress the disturbing effects.

The reference transducer and the dummy duct that is associated therewith are not used for expelling droplets. Thus, this duct is disconnected from the liquid supply. It may or may not be connected to a nozzle. In other respects, however, the design of the reference unit with its transducer and its duct is preferably identical with the design of the ejection units, so that the transducers will react upon the disturbing effects mentioned above in essentially the same way.

To subtract the detection signals, the transducers may form part of a bridge circuit which is balanced in order to compensate for any possible differences in the electrical properties of the transducers.

The nozzle head may comprise one or more dummy ducts, disconnected from a liquid ink supply. In general, however, the number of dummy ducts will be significantly smaller than the number of ejection units. Preferably, a switch network is provided for selectively connecting one of the transducers of the ejection units into the circuit that is used for a signal subtraction.

In conventional droplet ejection devices of this type, is it common practise that a detection signal of a transducer of an ejection unit is received only during intervals between the actuation pulses for that transducer. That is, the transducer is either connected to a signal source of the control circuit so that a control signal may be applied, or it is disconnected from this signal source and connected instead to a detection circuit. The reason is that the actuation pulse for the transducer would normally have such a high amplitude that it would mask the detection signal. In the device according to the invention, however, the same actuation pulses are applied to the transducer of the ejection unit that is to be monitored and to the reference transducer, and these pulses will cancel each other in the comparison or bridge circuit, so that what is detected is only the difference between the two detection signals, this difference being indicative of pressure waves that are present only in the liquid in the ejection unit but not in the dummy duct. In this way, it is possible to obtain a detection signal even in the periods in which the transducer is active, which permits to monitor the function of ejection unit more closely.

In a further aspect, the object is achieved in a method according to claim 7 for operating the droplet ejection device according to claim 1. In the method according to the present invention, at least one ejection unit is actuated, i.e. the transducer of said at least one ejection unit is actuated, and the reference transducer is actuated. A detection signal is received from the transducer and from the reference transducer. The detection signal from the reference transducer is subtracted from the detection signal from the transducer, thereby cancelling any other contributions than the contribution from the pressure fluctuations in the liquid in the duct of the ejection unit. Then, analyzing the resulting signal of the subtraction for determining the ejection unit status of said at least one ejection unit.

BRIEF DESCRIPTION OF THE DRAWINGS

An embodiment example will now be described in conjunction with the drawings, wherein.

DETAILED DESCRIPTION OF EMBODIMENTS

Figure 1:
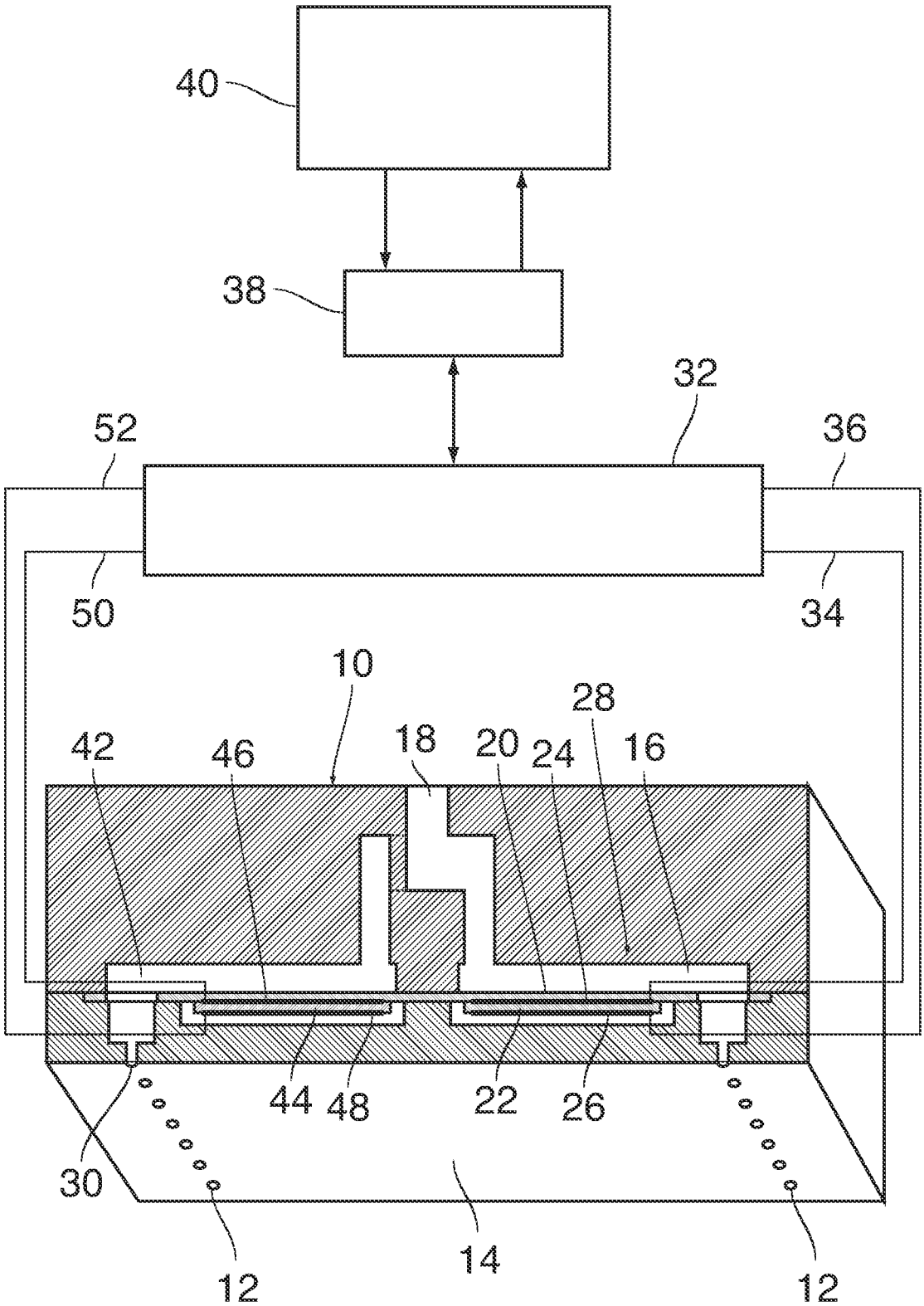
FIG. 1 is a perspective view, partly in cross-section, of a nozzle head of a device according to the invention, together with a block diagram of an electronic control circuit.

As is shown in FIG. 1, a droplet ejection device which may for example form part of an ink jet printer comprises a nozzle head 10 with plurality of nozzles 12 formed in a flat nozzle face 14. The nozzle head 10 may for example be formed by MEMS technology (Micro Electro Mechanical System).

Each nozzle 12 is connected to one end of a duct 16 that is filled with liquid ink. An opposite end of the duct 16 is connected to an ink supply line 18 that is common to all the nozzles 12 and ducts 16 of the entire nozzle head. One wall of each duct 16 is formed by a flexible membrane 20 to which an electromechanical transducer 22 is attached on the side outside of the duct 16. The transducer 22 has a number of electrodes 24 only two of which have been shown here. The transducer 22 may be a piezoelectric transducer with a plurality of layers of piezoelectric material stacked one upon the other and with internal electrodes intervening therebetween. The internal electrodes inside the piezoelectric material will then alternatingly be connected with the electrode 24 on the top side and the electrode 26 on the bottom side. In another embodiment, there is a single layer of piezoelectric material arranged between a bottom and an upper electrode, as shown. In particular in MEMS technology, such an actuator is formed by a thin film piezo provided by a sol-gel processing or a sputtering processing or any other suitable processing. When a voltage is applied to the electrodes, this will cause the transducer 22 to flex in a bending mode, resulting in a deflection of the membrane 20.

For example, when a voltage pulse is applied as an actuation pulse to the electrodes 24 and 26, the membrane 20 may flex downwardly so as to increase the volume inside the duct 16 at the rising flank of the pulse, so that ink will be sucked-in from the ink supply line 18. Then, on the descending flank at the end of the pulse, the membrane 20 will flex back into the original state, thereby compressing the ink in the duct 16, so that an acoustic pressure wave is generated in the liquid ink. This pressure wave propagates to the end of the duct 16 that is connected to the nozzle 12 and causes an ink droplet to be expelled from the nozzle.

The assembly constituted by a single one of the nozzles 12, the associated duct 16 and the associated transducer 22 will be designated as ejection unit 28 hereinafter.

In the example shown, the nozzles 12 are arranged in two parallel rows and each of these nozzles, with the exception of a single nozzle 30 which has been shown in cross-section in the left part of FIG. 1, forms part of another ejection device 28. The ejection devices 28 have all an identical design and are arranged mirror-symmetrically for the two rows of nozzles 12. In other commonly known embodiments, the nozzles of the two separate parallel rows may be arranged in a staggered manner to provide for a virtually higher nozzle density, i.e. a smaller nozzle pitch, allowing higher print resolutions. The electrodes 24 and 26 of each ejection unit 28 are connected to an electronic control circuit 32 via signal lines 34, 36 which have been shown only schematically in FIG. 1 and have been show only for a single one of the ejection units 28.

The control circuit 32 may take the form of an ASIC (Application Specific Integrated Circuit) and is arranged to generate the actuation pulses to be applied to the electrodes of the transducers 22 of each ejection unit.

When one of the transducers 22 is subject to pressure fluctuations that may have been caused for example by a previous actuation pulse of the same ejection unit or a neighbouring unit, this will cause a slight deformation of the piezoelectric material, so that a voltage will be induced in the electrodes 24, 26. This induced voltage forms a detection signal that is also transmitted to the control circuit 32 via the signal lines 34 and 36 and may be used for analyzing and assessing the pressure fluctuations in the ejection unit. When the ejection unit operates normally, a characteristic pattern of a decaying pressure wave will be detected subsequent to each actuation pulse. However, when any kind of malfunction occurs in the ejection unit, e.g. a complete or partial clogging of the nozzle 12, an air bubble being trapped in the nozzle or the duct, or mechanical damage of the transducer 22 or of the membrane 20, this will change the pattern of pressure fluctuations in a characteristic way. Consequently, by analysing the detected pressure fluctuations, it is possible to state that a malfunction has occurred, and it is also possible to identify the nature of the malfunction.

The control circuit 32 communicates with an FPGA 38 (Field Programmable Gate Array) that determines, under the control of a processor unit 40, the ejection units 28 to which the actuation pulses are to be delivered, and the ejection units from which detection signals are to be received. In this way, the nozzle head 10 can be controlled such that a desired image is formed on a print substrate (not shown) that is advanced underneath the nozzle face 14, and the functioning of the ejection units 28 can be monitored continuously during the print process.

The nozzle 30 that has been shown in cross-section in the left part of FIG. 1 and that does not form part of an ejection unit is connected to a dummy duct 42 that has the same configuration a the ducts 16 of the ejection units 28, with the only difference that its connection to the ink supply line 18 is blocked. One wall of the dummy duct 42 is formed by the membrane 20, and a reference transducer 44 which has the same design as any of the transducers 22 is associated with the duct 42 in the same manner as the transducers 22 are associated with the ducts 16. The reference transducer 44 has electrodes 46 and 48 that are connected to the control circuit 32 via signal lines 50, 52.

The voltages that are induced in the electrodes 24 and 26 of the transducers 22 of the ejection units 28 will depend not only upon the acoustic waves in the liquid in the duct 16 but will also be influenced by several other factors including, for example, the temperature of the transducer, secular changes (ageing) in the mechanical properties of the transducer 22 and the membrane 20, and the like. Furthermore, the nozzle head 10 may be subject to external shocks which cause vibrations in the solid material of the nozzle head. These vibrations will be transmitted to the transducer via the membrane 20 and will cause noise signals in the electrodes.

However, all these factors will influence the voltage at the electrodes 46, 48 of the reference transducer 44 in essentially the same way. Only, since the dummy duct 42 does not contain liquid ink, the reference transducer 44 will not be influenced by any acoustic waves propagating in a liquid. Consequently, when the detection signals obtained from one of the transducers 22 on the one hand and from the reference transducer 44 on the other hand are subtracted from one another, the resulting difference will represent only the pressure fluctuations and acoustic waves in the liquid, i.e. the information one is actually interested in, whereas all disturbance factors will essentially cancel out.

Figure 2:
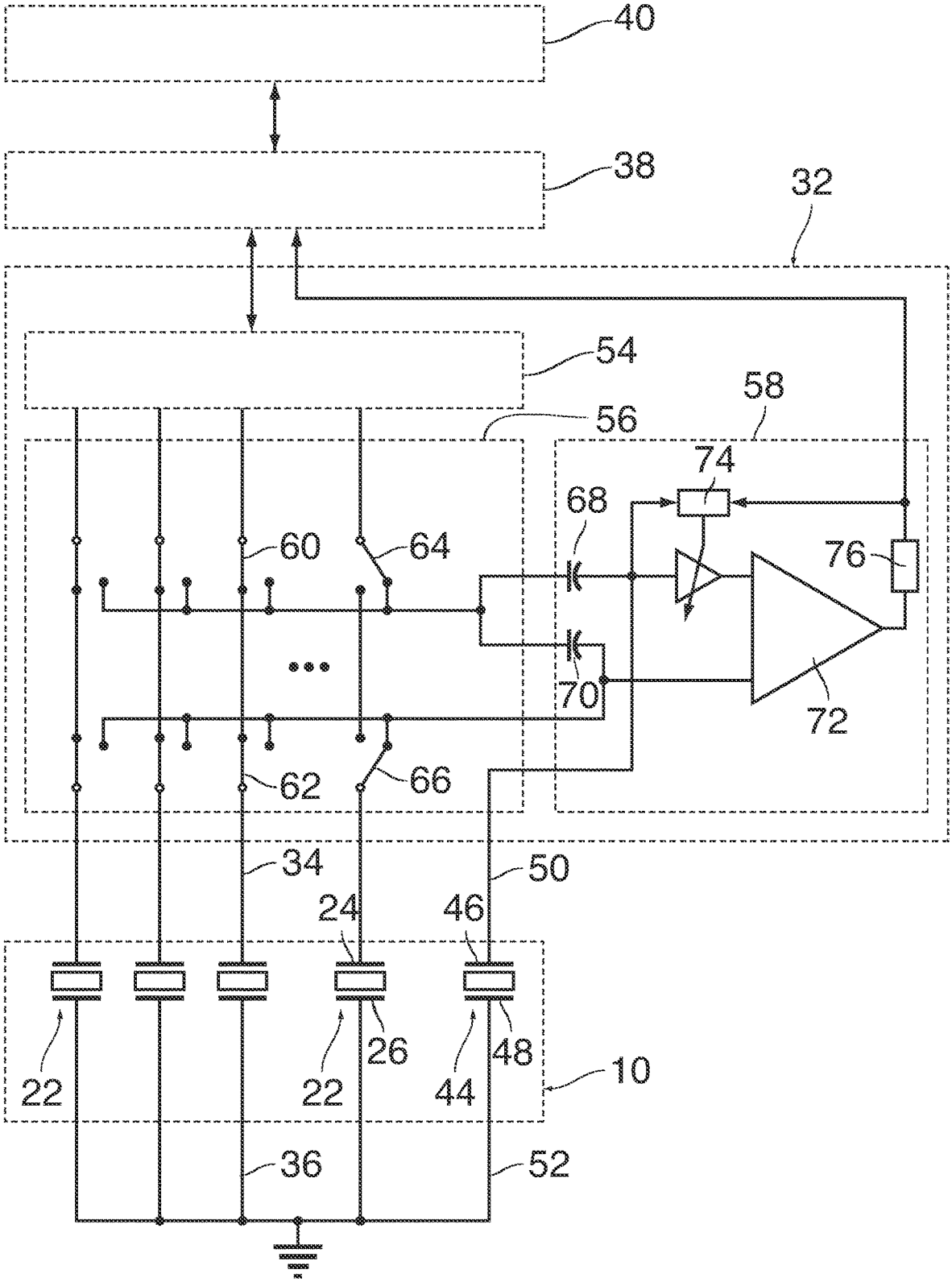
FIG. 2 is a circuit diagram of essential parts of the electronic control circuit.

FIG. 2 is a more detailed circuit diagram of the control circuit 32, including the transducers 22 and the reference transducer 44 which, electronically, can be considered as capacitors.

The control circuit 32 includes a waveform generator 54, an output stage 56 and a detection circuit 58, which functions as the subtraction circuit according to the present invention. The waveform generator 54 generates control signals with waveforms consisting of actuation pulses for individually controlling each of the transducers 22 of the ejection units under the control of the FPGA 38. To that end, the waveform generator has a separate output for each transducer 22. Of course, in practice, the FPGA may be suitably embodied differently. For example, a general purpose processor unit with suitable software code may be applied.

The output stage 56 includes a network of switches 60, 62, 64, 66 arranged to connect each of the transducers 22 to the corresponding output of the waveform generator 54 either directly or indirectly via the detection circuit 58. In the example shown, the switches 60 and 62 are closed, so that the corresponding transducer is directly connected to the waveform generator 54 and disconnected from the detection circuit 58. In contrast, switches 64 and 66 are shown in a state, in which the direct connection is interrupted and, instead, the output of the waveform generator 54 is connected to an input of the detection circuit 58 (via switch 64), and an output of the detection circuit is connected to the associated transducer 22 (via switch 66).

The input of the detection circuit 58 splits into two branches each of which contains a capacitor 68 and 70, respectively. The capacitor 68 is connected to one input of a comparator 72 via a self-balancing circuit 74 and is further connected to one electrode 46 of the reference transducer 44. The capacitor 70 is connected to another input of the comparator 72 and, via the closed switch 66, to one electrode 24 of the associated transducer 22. The other electrodes 26 and 48 of the transducers 22 and the reference transducer 44 are grounded.

The capacitors 68, 70, the transducer 22 that is connected to the detection circuit 58, and the reference transducer 44 constitute a bridge circuit that is balanced by means of the self-balancing circuit 74 such that, when no pressure waves are present in the duct 16, the output of the comparator 72 will be zero. The analog output is digitised in an A/D-converter 76, and the digitised output is transmitted to the processor unit 40 via the FPGA 38 and is further fed back to the self-balancing circuit 74. The capacitors 68 and 70 function is this circuit as bridge balancing elements and may also be implemented as resistors or combinations of passive electronic components, as long as they are able to balance the bridge circuit in a relevant frequency range.

Since both inputs of the comparator 72 are connected to the switch 64 via the capacitors 68 and 70, the output of the comparator will not change when the level the voltage signal that is output via the switch 64 changes.

When an actuation pulse occurs at this output, the voltage pulse will be transmitted to the transducer 22 via the capacitor 70 and the closed switch 66, and the associated nozzle 12 will be fired. During this time, and also during the subsequent time interval when the actuation pulse has dropped-off again, the detection signal from this transducer 22 will constantly be measured by the detection circuit 58. When pressure fluctuations occur in the liquid in the duct 22, a voltage will be induced in the electrode 24 of the transducer 22, and this voltage will cause an imbalance at the inputs of the comparator 72, and a corresponding detection signal will be sent from the A/D-converter 76 to the processor unit 40. The processor unit 40 operates as the analysis circuit. The processor unit 40 as such receives the output of the A/D converter 76 and executes a predetermined analysis routine for determining an ejection unit status based on the detected pressure fluctuations in the liquid of the corresponding ejection unit.

The switches 60-66 may be controlled either by the processor unit 40 or by an internal controller of the control circuit 32, so that the transducers 22 of all ejection units 28 may be connected to the measuring circuit 28 one after the other in accordance with a predetermined time pattern and, consequently, the functioning of all ejection units can be monitored with high time resolution. Of course, it is possible to provide two or more dummy ducts 42 and reference transducers 44 in order to monitor the ejection units more closely.

In the example shown in FIG. 1, the dummy duct 42 is disconnected from the ink supply line 18 and is connected to the open atmosphere via the nozzle 30. In a modified embodiment, the dummy duct may be connected to a dampening member rather than to a nozzle. It may even permanently contain liquid ink or a suitable standard liquid, as long as it does not eject a droplet. In that case, the reference transducer 44 will generate pressure waves in the permanent liquid, but these waves will be attenuated by the dampening member in accordance with a fixed pattern. The subtraction will result in a comparison between the fixed pattern and the pattern observed in the ejection units 28.

Operating the droplet ejection device according to FIG. 2 includes performing the method according to the present invention. In particular, the bridge circuitry included in the detection circuit 58 results in that the method steps of generating a pressure wave in the liquid in at least one of the ejection units by actuating a transducer of the ejection unit and actuating the reference transducer of the reference unit need to be performed simultaneously. If the pressure fluctuations during actuation are desired to be detected, the step of subtracting a detection signal of the reference electromechanical transducer from a detection signal of the transducer (22) of the at least one of the ejection units needs to be started simultaneously, too. The step of analyzing by the processor unit 40 may be started as soon as possible, which may be dependent on the predetermined analysis routine to be executed by the processor unit 40. In an embodiment, the output of the detection circuit 58 may as well be stored in a computer memory, or the like, and be analyzed later.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A droplet ejection device comprising:

a. a nozzle head comprising a plurality of ejection units, each ejection unit comprising a nozzle, a duct connected to the nozzle and fluidly connected to a liquid supply channel for receiving a liquid in the duct, and an electromechanical transducer arranged to generate a pressure wave in the liquid in the duct so as to expel a droplet of the liquid from the nozzle; and b. an electronic control circuit arranged to apply control signals to the transducers and to receive detection signals that are generated in the transducers in response to the transducer being exposed to pressure fluctuations, wherein the nozzle head further comprises a reference unit with a reference duct, which reference duct is not fluidly connected to the liquid supply channel such that the reference duct remains free from the liquid, and a reference electromechanical transducer, and wherein the control circuit comprises:

a subtracting circuit for subtracting a detection signal of the reference electromechanical transducer from a detection signal of a transducer of at least one of the ejection units; and an analysis circuit for analyzing an output of the subtracting circuit for determining an ejection unit status.

2. The device according to claim 1, wherein the transducers of the ejection units and the reference transducer are piezoelectric transducers.

3. The device according to claim 1, wherein the control circuit comprises two bridge balancing elements which constitute a bridge circuit together with the capacitances of the transducer of said at least one of the ejection units and the capacitance of the reference transducer.

4. The device according to claim 3, wherein the control circuit includes a comparator and a balancing circuit connected to the bridge circuit.

5. The device according to claim 1, wherein the control circuit includes a waveform generator for generating a control signal to be applied to a transducer of an ejection unit, said waveform generator having a separate output for each individual transducer, and the control circuit further comprises an output stage with a network of switches arranged for selectively connecting each output of the waveform generator to the associated transducer either directly or indirectly via the detection circuit for subtracting the detection signals.

6. The device according to claim 5, wherein the control circuit is arranged to apply the control signal to the transducer of said at least one of the ejection units and also to the reference transducer.

7. A method of determining an ejection unit status for a droplet ejection device according to claim 1, wherein each of the plurality of ejection units hold an amount of a liquid and the reference unit is free of liquid, the method comprising:

a. generating a pressure wave in the liquid in at least one of the ejection units by actuating a transducer of the ejection unit;

b. actuating the reference transducer of the reference unit;

c. subtracting a detection signal of the reference electromechanical transducer from a detection signal of the transducer of the at least one of the ejection units; and d. determining an ejection unit status by analyzing the signal resulting from step c.

8. The method of claim 7, wherein steps a, b and c are started simultaneously and wherein step c is continued for predetermined amount of time after steps a and b are stopped.

9. The device according to claim 5, wherein the transducers of the ejection units and the reference transducer are piezoelectric transducers.

10. The device according to claim 5, wherein the control circuit comprises two bridge balancing elements which constitute a bridge circuit together with the capacitances of the transducer of said at least one of the ejection units and the capacitance of the reference transducer.

11. The device according to claim 10, wherein the control circuit includes a comparator and a balancing circuit connected to the bridge circuit.

* * * * *